US009093217B2

(12) United States Patent
Duval

(10) Patent No.: US 9,093,217 B2
(45) Date of Patent: Jul. 28, 2015

(54) THREE PHASE ROTARY TRANSFORMER WITH FREE LINKED FLUXES

(71) Applicant: LABINAL POWER SYSTEMS, Blagnac (FR)

(72) Inventor: Cedric Duval, Samois sur Seine (FR)

(73) Assignee: LABINAL POWER SYSTEMS, Blagnac (FR)

( * ) Notice: Subject to any disclaimer, the term of this patent is extended or adjusted under 35 U.S.C. 154(b) by 0 days.

(21) Appl. No.: 14/399,709

(22) PCT Filed: May 3, 2013

(86) PCT No.: PCT/FR2013/050983

§ 371 (c)(1),
(2) Date: Nov. 7, 2014

(87) PCT Pub. No.: WO2013/167827

PCT Pub. Date: Nov. 14, 2013

(65) Prior Publication Data

US 2015/0116067 A1 Apr. 30, 2015

(30) Foreign Application Priority Data

May 9, 2012 (FR) ..... 12 54223

(51) Int. Cl.
*H01F 21/06* (2006.01)
*H01F 38/18* (2006.01)
*H01F 30/12* (2006.01)

(52) U.S. Cl.
CPC ..... *H01F 38/18* (2013.01); *H01F 21/06* (2013.01); *H01F 30/12* (2013.01)

(58) Field of Classification Search
IPC ..... H01F 21/06,21/00
See application file for complete search history.

(56) References Cited

U.S. PATENT DOCUMENTS 5,739,986 A * 4/1998 Van Vlerken et al. ..... 360/281.8
2005/0225188 A1 10/2005 Griepentrog et al.
2011/0050377 A1 3/2011 Bjerknes et al.

FOREIGN PATENT DOCUMENTS

WO 2004/021376 A1 3/2004
WO 2009/128724 A1 10/2009
WO 2009/147550 A1 12/2009

OTHER PUBLICATIONS

International Search Report issued Jun. 20, 2013 in PCT/FR2013/050983 filed May 3, 2013.

* cited by examiner

*Primary Examiner* — Tuyen Nguyen
(74) *Attorney, Agent, or Firm* — Oblon, McClelland, Maier & Neustadt, L.L.P.

(57) ABSTRACT

A rotary three-phase transformer with free linked fluxes including a first portion and a second portion that are movable in rotation relative to each other about an axis A. A first body defines a first annular slot of axis A, a second annular slot of axis A, a third annular slot of axis A, and a fourth annular slot of axis A. The coils of the first portion include a first toroidal coil of axis A in the first slot, a second toroidal coil of axis A in the second slot, a third toroidal coil of axis A in the second slot, a fourth toroidal coil of axis A in the third slot, a fifth toroidal coil of axis A in the third slot, and a sixth toroidal coil of axis A in the fourth slot.

8 Claims, 3 Drawing Sheets

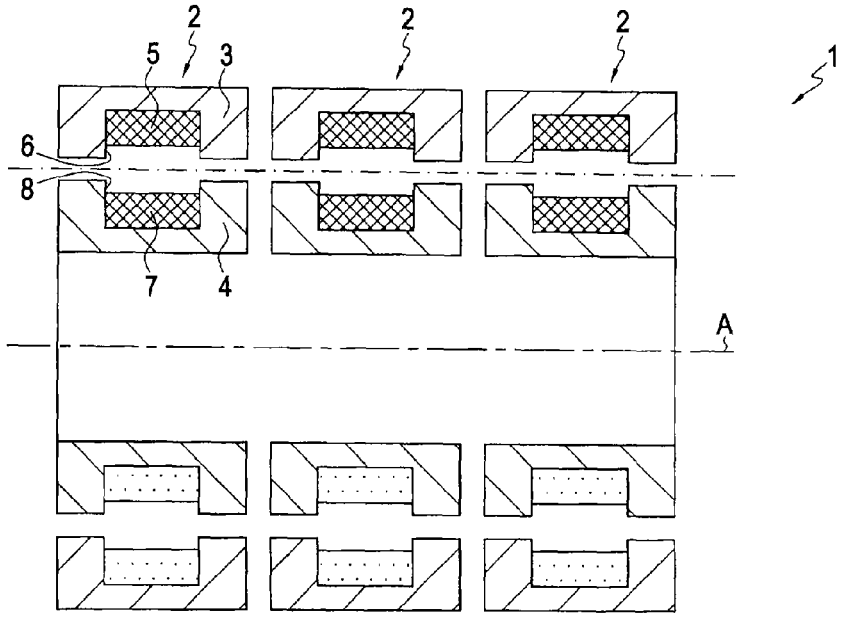
FIG.1
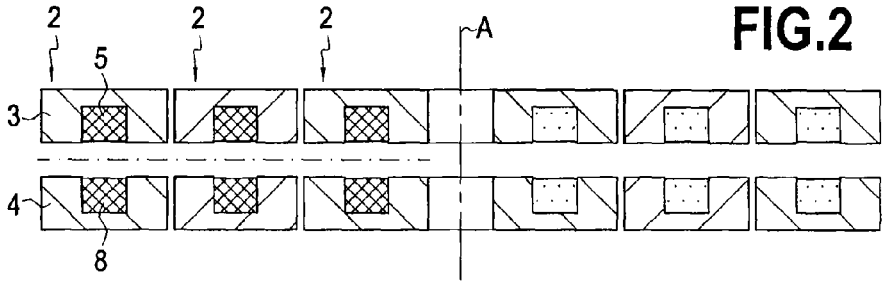
FIG.2
FIG.5
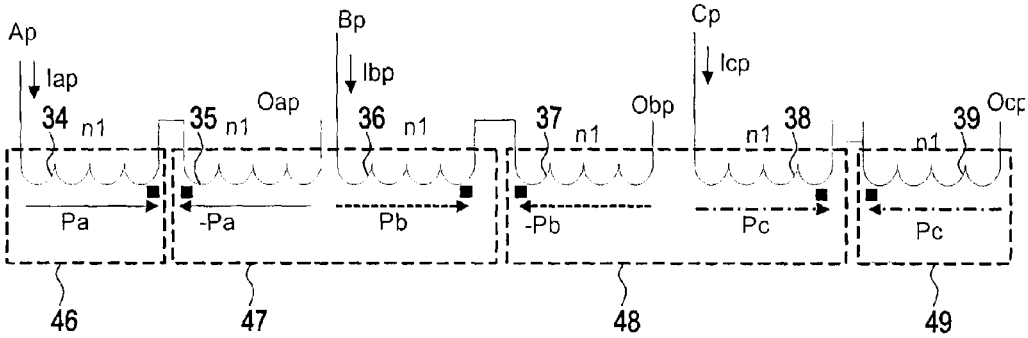

FIG.4
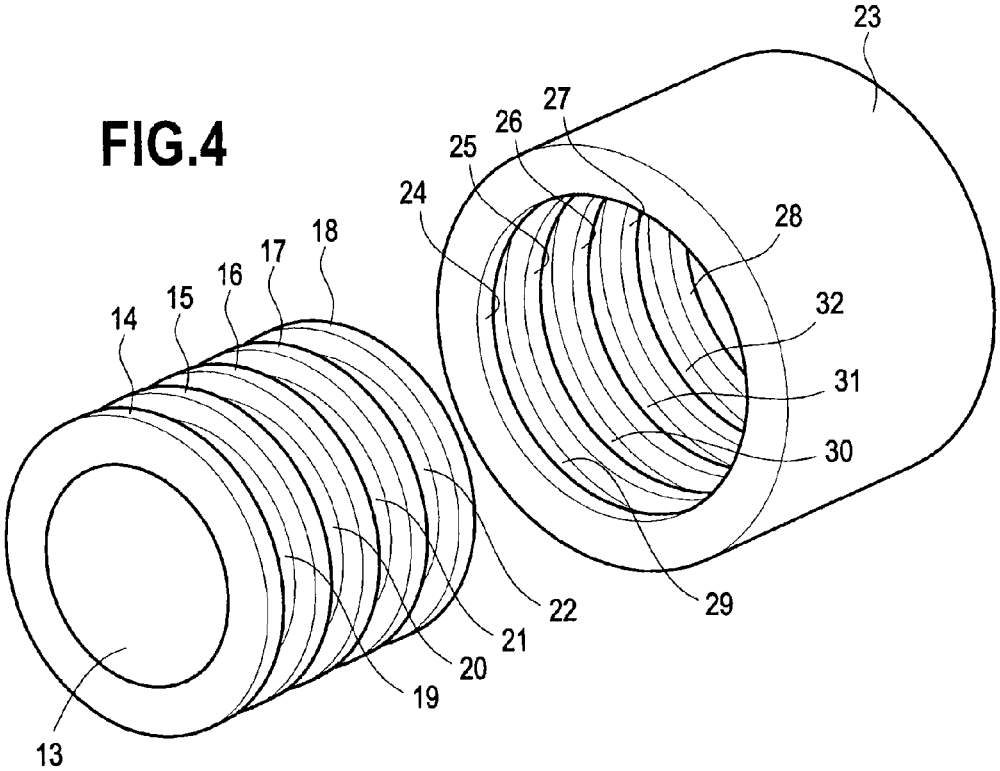
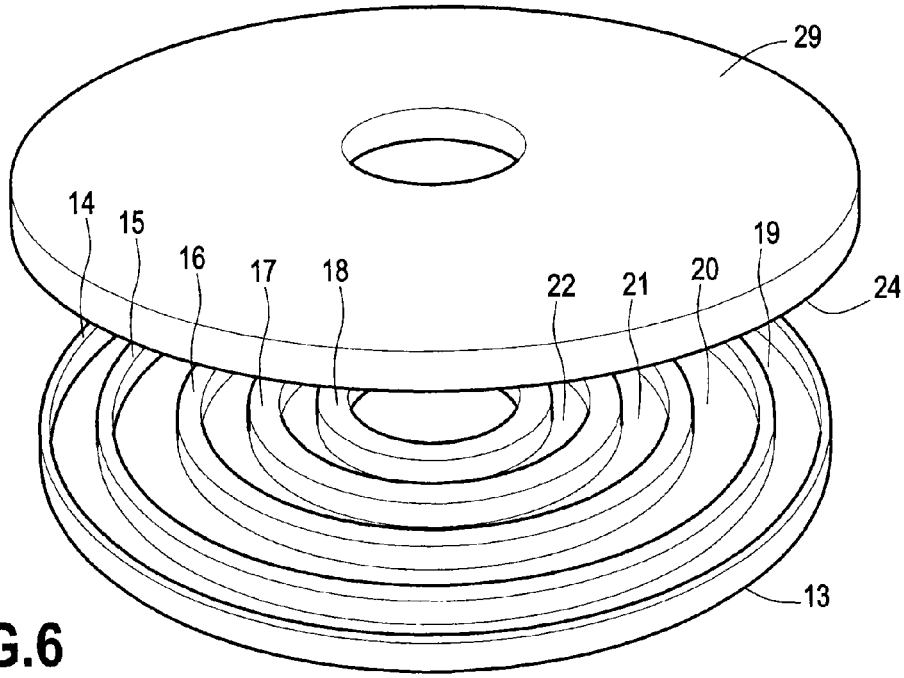
FIG.6

THREE PHASE ROTARY TRANSFORMER WITH FREE LINKED FLUXES

BACKGROUND OF THE INVENTION

The present invention relates to the general field of transformers. In particular, the invention relates to a rotary three-phase transformer.

A rotary three-phase transformer serves to transfer energy and/or signals without contact between two axes rotating one relative to the other.

FIGS. 1 and 2 show respective rotary three-phase transformers 1 of the prior art.

The transformer 1 has three rotary single-phase transformers 2 corresponding to phases U, V, and W. Each rotary single-phase transformer 2 has a portion 3 and a portion 4 rotating one relative to the other about an axis A. By way of example, the portion 3 is a stator and the portion 4 is a rotor, or vice versa. In a variant, the portion 3 and the portion 4 are both movable in rotation relative to a stationary frame of reference (not shown). A toroidal coil 5 is received in a slot 6 defined by a body made of ferromagnetic material of the portion 3. A toroidal coil 7 is received in a slot 8 defined by a body made of ferromagnetic material of the portion 4. For each rotary single-phase transformer 2, the coils 5 and 7 form primary and secondary coils (or vice versa).

FIG. 1 shows a variant referred to as "U-shaped" in which the portion 3 surrounds the portion 4 about the axis A, while FIG. 2 shows a variant referred to as "E-shaped" or "pot-shaped", in which the portion 3 and the portion 4 are one beside the other in the axial direction.

The three-phase transformer 1 of FIG. 1 or 2 presents weight and volume that are large since it is not possible to make best use of the magnetic fluxes of each of the phases, unlike a static three-phase transformer with forced fluxes in which it is possible to couple the fluxes. Furthermore, in the example of FIG. 2, it is necessary to use electrical conductors of sections that differ as a function of the distance between the axis of rotation and the phase, in order to conserve balanced resistances.

Document US 2011/0050377 describes a four-column rotary three-phase transformer. That transformer presents considerable weight and volume. That document also describes a five-column rotary three-phase transformer. That transformer presents considerable weight and volume. Furthermore, it makes use of radial winding passing via slots in the central columns of the magnetic circuit, where such winding is more complex to perform than the toroidal winding used in the transformers of FIGS. 1 and 2.

There thus exists a need to improve the topology of a three-phase transformer.

OBJECT AND SUMMARY OF THE INVENTION

The invention proposes a rotary three-phase transformer comprising a first portion and a second portion that are movable in rotation relative to each other about an axis A, the first portion comprising a first body of ferromagnetic material and coils, the second portion comprising a second body of ferromagnetic material and coils;

- the first body defining a first annular slot of axis A, a second annular slot of axis A, a third annular slot of axis A, and a fourth annular slot of axis A;
- the coils of the first portion comprising a first toroidal coil of axis A in the first slot, a second toroidal coil of axis A in the second slot, a third toroidal coil of axis A in the second slot, a fourth toroidal coil of axis A in the third slot, a fifth toroidal coil of axis A in the third slot, and a sixth toroidal coil of axis A in the fourth slot;
- the first coil and the second coil being connected in series and presenting respective winding directions that, for a current flowing in the first coil and in the second coil, correspond to two magnetic potentials of opposite directions;
- the third coil and the fourth coil being connected in series and presenting respective winding directions that, for a current flowing in the third coil and the fourth coil, correspond to two magnetic potentials of opposite directions; and
- the fifth coil and the sixth coil being connected in series and presenting respective winding directions that, for a current flowing in the third coil and the sixth coil, correspond to two magnetic potentials of opposite directions.

By way of example, the first portion may act as a primary. Under such circumstances, if three-phase currents are caused to flow in appropriate directions in the primary oils, the magnetic potentials of the primary coils lead to coupling of the fluxes, given the above-mentioned winding directions. This coupling enables the transformer to be of reduced dimensions in terms of volume and weight. Furthermore, the primary the transformer makes use only of simple toroidal coils of axis A, thus enabling its structure to be particularly simple. In other words, the invention provides a rotary three-phase transformer, that by virtue of the fluxes being coupled, presents weight and volume that are reduced, in particular relative to using three single-phase rotary transformers, and it uses a form of winding that is particularly simple.

In an implementation, the first coil, the second coil, the third coil, the fourth coil, the fifth coil, and the sixth coil all present the same number of turns.

The phases of the first portion are then balanced in resistance.

In an embodiment, the second body defines a fifth annular slot of axis A, a sixth annular slot of axis A, a seventh annular slot of axis A, and an eighth annular slot of axis A;

- the coils of the second portion comprise a seventh toroidal coil of axis A in the fifth slot, an eighth toroidal coil of axis A in the sixth slot, a ninth toroidal coil of axis A in the sixth slot, a tenth toroidal coil of axis A in the seventh slot, an eleventh toroidal coil of axis A in the seventh slot, and a twelfth toroidal coil of axis A in the eighth slot;
- the seventh coil and the eighth coil being connected in series and presenting respective winding directions that, for a current flowing in the seventh coil and in the eighth coil, correspond to two magnetic potentials of opposite directions;
- the ninth coil and the tenth coil being connected in series and presenting respective winding directions that, for a current flowing in the ninth coil and in the tenth coil, correspond to two magnetic potentials of opposite directions; and
- the eleventh coil and the twelfth coil being connected in series and presenting respective winding directions that, for a current flowing in the eleventh coil and in the twelfth coil, correspond to two magnetic potentials of opposite directions.

In this embodiment, the secondary is made on the same principle as the primary. The secondary thus also contributes to limiting the weight and the volume of the transformer, and enables the transformer to be made while using only toroidal coils of axis A.

The seventh coil, the eighth coil, the ninth coil, the tenth coil, the eleventh coil, and the twelfth coil may all present the same number of turns.

The phases of the second portion are then balanced in resistance.

In an embodiment, the first body comprises a ring, a first leg, a second leg, a third leg, a fourth leg, and a fifth leg defining said slots of the first body.

The second portion may surround the two-phase portion around the axis A, or vice versa. That corresponds to making a transformer that is referred to as being "U-shaped".

The first portion and the second portion may be situated one beside the other in the direction of the axis A. That corresponds to making a transformer that is referred to as being "E-shaped" or "pot-shaped".

In an embodiment, the first and second bodies made of ferromagnetic material completely surround the primary and the secondary coils.

Under such circumstances, the transformer is magnetically shielded.

BRIEF DESCRIPTION OF THE DRAWINGS

Other characteristics and advantages of the present invention appear from the following description made with reference to the accompanying drawings, which show implementations having no limiting character. In the figures:

FIGS. 1 and 2 are each a section view of a prior art rotary three-phase transformer;

FIG. 4 is an exploded perspective view of the magnetic circuit of the FIG. 3 transformer;

FIG. 5 is an electrical circuit diagram showing the connections of the coils in the FIG. 3 transformer; and FIG. 6 is an exploded view in perspective of the magnetic circuit of a transformer in a second embodiment of the invention.

DETAILED DESCRIPTION OF EMBODIMENTS

Figure 3:
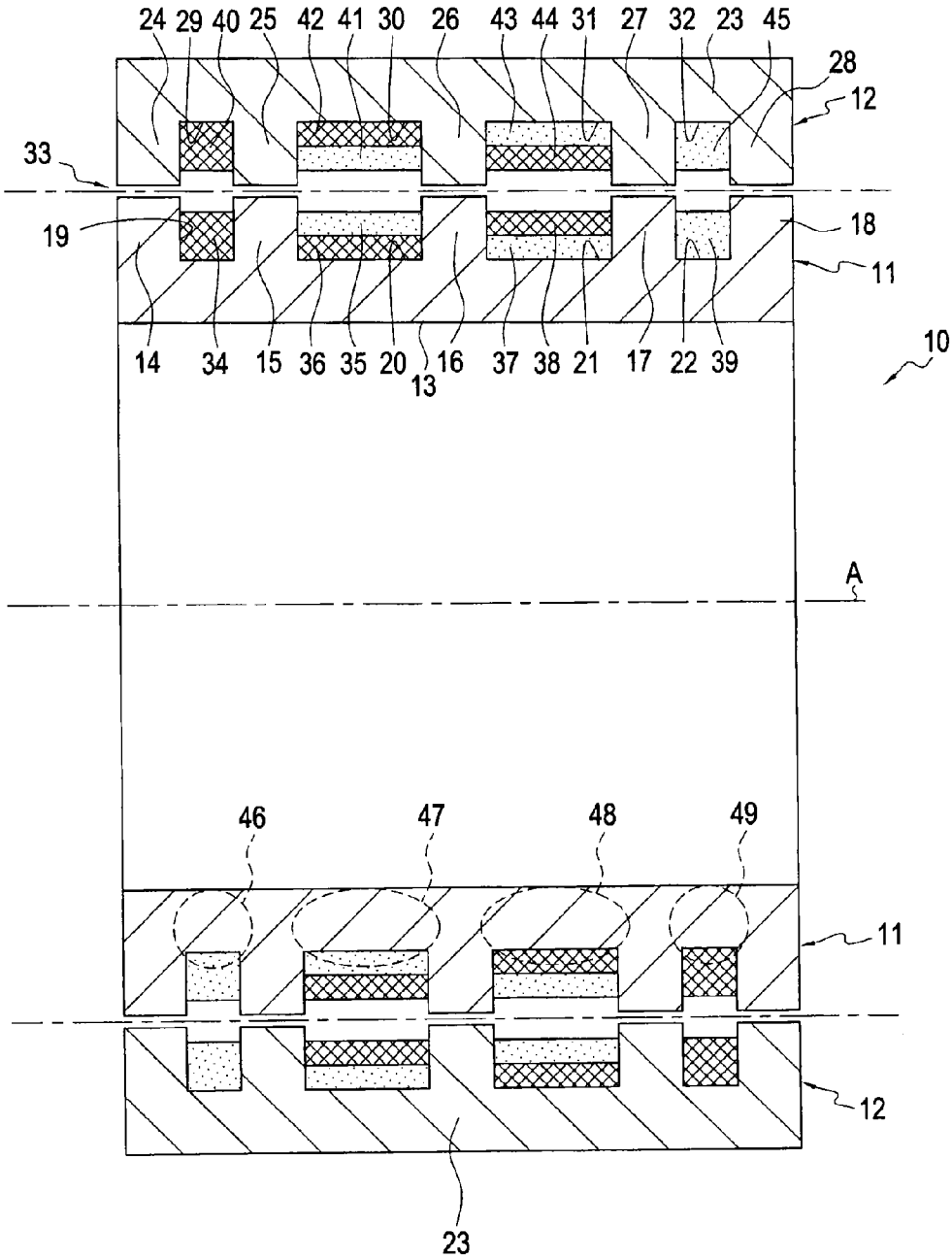
FIG. 3 is a section view of a magnetically shielded three-phase rotary transformer with free linked fluxes in a first embodiment of the invention.

FIG. 3 is a section view of a rotary transformer 10 in an embodiment of the invention. The transformer 10 is a magnetically shielded three-phase rotary transformer with free linked fluxes.

The transformer 10 comprises a portion 11 and a portion 12 that are suitable for rotating relative to each other about an axis A. By way of example, the portion 11 is a stator and the portion 12 is a rotor, or vice versa. In a variant, the portion 11 and the portion 12 are both movable in rotation relative to a stationary frame of reference (not shown).

The portion 11 comprises a ring 13 of axis A and five legs 14, 15, 16, 17, and 18 made of ferromagnetic material. Each of the legs 14, 15, 16, 17, and 18 extends radially away from the axis A, starting from the ring 13. The leg 14 is at one end of the ring 13, the leg 18 is at another end of the ring 13, and the legs 15, 16, and 17 lie between the legs 14 and 18.

The ring 13 and the legs 14 and 15 define an annular slot 19 of axis A that is open in a radially outward direction (i.e. away from the axis A). The ring 13 and the legs 15 and 16 define an annular slot 20 of axis A that is open in a radially outward direction. The ring 13 and the legs 16 and 17 define an annular slot 21 of axis A that is open in a radially outward direction. The ring 13 and the legs 17 and 18 define an annular slot 22 of axis A that is open in a radially outward direction. In general manner, the ring 13 and the legs 14 to 18 form a body of ferromagnetic material defining four annular slots 19 to 22 that are open in a radially outward direction.

The portion 12 comprises a ring 23 of axis A and five legs 24, 25, 26, 27, and 28 made of ferromagnetic material. Each of the legs 24, 25, 26, 27, and 28 extends radially towards the axis A, starting from the ring 23. The leg 24 is at one end of the ring 23, the leg 28 is at another end of the ring 23, and the legs 25, 26, and 27 lie between the legs 24 and 28.

The ring 23 and the legs 24 and 25 define an annular slot 29 of axis A that is open in a radially inward direction (i.e. towards the axis A). The ring 23 and the legs 25 and 26 define an annular slot 30 that is open in a radially inward direction. The ring 23 and the legs 26 and 27 define an annular slot 31 that is open in a radially inward direction. The ring 23 and the legs 27 and 28 define an annular slot 32 that is open in a radially inward direction. In general manner, the ring 23 and the legs 24 to 28 form a body of ferromagnetic material defining four annular slots 29 to 32 that are open in a radially inward direction.

Each of the legs 14 to 18 of the portion 11 faces one of the legs 24 to 28 of the second portion 12, defining an airgap 33 between them. A transformer 10 thus presents five pairs of legs (legs 14 & 24, legs 15 & 25, legs 16 & 26, legs 17 & 27, and legs 18 & 28), each pair of legs forming a column of the transformer 10. In other words, the transformer 10 is thus a five-column transformer. The rings 13 and 23 together with the legs 14 to 18 and 24 to 28 form a magnetic circuit of the transformer 10. FIG. 4 is an exploded perspective view of the magnetic circuit of the transformer 10.

The portion 11 of the transformer 10 has coils 34 to 39, and the portion 12 has coils 40 to 45.

The coil 34 is a toroidal coil of axis A and it is located in the slot 19. The coil 35 is a toroidal coil of axis A, it is located in the slot 20, and it is connected in series with the coil 34. The coil 36 is a toroidal coil of axis A and it is located in the slot 20. The coil 37 is a toroidal coil of axis A, it is located in the slot 21, and it is connected in series with the coil 36. The coil 38 is a toroidal coil of axis A and it is located in the slot 21. Finally, the coil 39 is a toroidal coil of axis A, it is located in the slot 22, and it is connected in series with the coil 38. Each of the coils 34 to 39 presents $n_1$ turns.

The term "toroidal coil of axis A" is used to mean a coil having its turns wound around the axis A. The term "toroidal" is not used in the limited meaning referring to a solid as generated by rotating a circle about an axis. On the contrary, as in the examples shown, the section of a toroidal coil may be rectangular, in particular.

In corresponding manner, the coil 40 is a toroidal coil of axis A and it is located in the slot 29. The coil 41 is a toroidal coil of axis A, it is located in the slot 30, and it is connected in series with the coil 40. The coil 42 is a toroidal coil of axis A and it is located in the slot 30. The coil 43 is a toroidal coil of axis A, it is located in the slot 31, and it is connected in series with the coil 42. The coil 44 is a toroidal coil of axis A and it is located in the slot 31. Finally, the coil 45 is a toroidal coil of axis A, it is located in the slot 32, and it is connected in series with the coil 44. Each of the coils 40 to 45 presents $n_2$ turns.

The coils 34 and 40 surround a magnetic core 46 situated in the ring 13. The term "magnetic core" is used to mean a portion of the magnetic circuit in which the same-direction flux created by the coil is in the majority. An electric current flowing in the coil 19 all the coil 14 thus corresponds to a magnetic potential in the magnetic core 46. In corresponding manner, the coils 35, 36, 41, and 42 surround a magnetic core 47 situated in the ring 13, the coils 37, 38, 43, and 44 surround a magnetic core 48 situated in the ring 13, and the coils 39 and 45 surrounds a magnetic core 49 situated in the ring 13.

In the description below, it is considered that the portion 11 and the coils 34 to 39 correspond to the primary of the transformer 10, and that the portion 12 and the coils 40 to 45 correspond to the secondary of the transformer 10. Nevertheless, primary and secondary may naturally be inverted.

FIG. 5 is an electrical circuit diagram showing the connections of the coils 34 to 39 of the transformer 10 and the corresponding magnetic potentials.

In FIG. 5, the following notation is used:

$A_p$, $B_p$, and $C_p$, are the inlet points of the primary coils of the transformer 10.

$I_{ap}$, $I_{bp}$, and $I_{cp}$ are the respective incoming currents at the points $A_p$, $B_p$, and $C_p$. The current $I_{ap}$ flows in the coils 34 and 35, which form a primary phase A. In corresponding manner, the current $I_{bp}$ flows in the coils 36 and 37, which form a primary phase B, and the current $I_{cp}$ flows in the coils 38 and 39, which form a primary phase C. Any other correspondence between the phases A, B, and C, and the pairs of coils in series is possible, providing the same correspondence is used in the secondary.

$O_{ap}$, $O_{bp}$, and $O_{cp}$ are the connection points making it possible electrical to have couplings that are identical to any kind of static three-phase transformer (star-star, star-delta, delta-delta, delta-star, zigzag, . . . ).

Black dots show the relationship between the current flowing in a coil and the direction of the corresponding magnetic potential: If the dot is on the right of the winding, the winding direction is such that the magnetic potential created is in the same direction as the incoming current. If the dot is on the left of the winding, the winding direction causes the magnetic potential that is created to be in the opposite direction relative to the incoming current.

Pa & −Pa are the magnetic potentials in the cores 46 and 47 corresponding to the current $I_{ap}$, Pb & −Pb are the magnetic potentials in the cores 47 and 48 corresponding to the current $I_{bp}$, and Pc & −Pc are the magnetic potentials in the cores 46 and 47 corresponding to the current $I_{cp}$.

It can be seen in FIG. 5 that by an appropriate selection for the winding directions and for the series connections shown in FIG. 5, balanced three-phase currents $I_{ap}$, $I_{bp}$, and $I_{cp}$ correspond in the core 46 to a magnetic potential Pa, in the magnetic core 47 to magnetic potentials −Pa and Pb that are equal in modulus and opposite in direction, and in the magnetic cores 48 and 49 to magnetic potentials −Pb, −Pc, and Pc that are symmetrical with Pb, −Pa, and Pa respectively. In this situation, the fluxes are linked correctly.

In a variant, other ways of connecting the coils and other winding directions enable the same organization to be obtained for the magnetic potentials.

Thus, in the transformer 10, the magnetic coupling performed by the magnetic circuit with the winding topologies shown makes it possible to have the same coupling coefficient of 5/4 for the fluxes created as for a static three-phase transformer with linked fluxes and five columns relative to a single-phase transformer. In order to have the best coupling coefficient, it is necessary for the reluctances in each of the columns (due mainly to the airgap 33) to be equal and for them to be strongly preponderant compared with the reluctances of the rings 13 and 23. In order to have a three-phase transformer that tends towards perfect equilibrium, it is necessary for the reluctances of the rings 13 and 23 to be as small as possible compared with the reluctances of each of the columns. Since that is difficult to achieve physically, one solution consists in modifying the reluctances of the columns and of the portions of the rings between two columns in such a manner as to obtain perfect balancing.

If the number of turns in the coils of the secondary is written $n_2$, then as in any three-phase transformer, the ratio of the voltages is given to a first approximation by $n_2/n_1$ and that of the currents by $n_1/n_2$. The rotary transformer 10 presents the same properties as any static three-phase transformer with linked fluxes, including the possibility of possessing a plurality of secondaries.

The transformer 10 presents several advantages.

In particular, it can be seen that the magnetic circuit completely surrounds the coils 34 to 39 and 40 to 45. The transformer 10 is thus magnetically shielded. Furthermore, the coils 34 to 39 and 40 to 45 are all toroidal coils of axis A. The transformer 10 therefore does not require coils that are more complex in shape.

Furthermore, since each phase presents the same number of turns of the same length (i.e. $2*n_1$ for the primary and $2*n_2$ for the secondary), the phases of the transformer 10 are balanced in resistance, without requiring conductors of different sections.

Finally, the transformer 10 presents reduced weight and volume. Specifically, because of the coupling of the fluxes, the transformer 10 may be dimensioned, for constant joule losses, to have weight and volume that are small compared with the transformers of FIGS. 1 and 2.

By acting on the reluctances of the various columns, it is possible to come close to balanced reluctances for the phases of the transformer 10. In order to improve phase balancing, it is possible to envisage making one degree of freedom available, namely the number of ampere-turns of the phases. Thus, in a variant that is not shown, the coils do not all have exactly the same number of turns $n_1$ or $n_2$.

The positions of the coils shown in FIG. 3 constitute one example, and other positions can be suitable. For example, in one slot, two coils may be one beside the other in the axial direction, one around the other about the axis A, or mixed one with the other.

The transformer 10 may be considered as being a "U-shaped" variant. In an embodiment that is not shown, the transformer in accordance with the invention is an "E-shaped" or a "pot-shaped" variant of the "U-shaped" transformer 10. In this variant, in similar manner to FIG. 2, the portion 11 and the portion 12 are situated one beside the other in the direction of the axis A. FIG. 6 is an exploded perspective view of the magnetic circuit of this "E-shaped" transformer. In FIG. 6, the same references as in FIG. 4 are used to designate corresponding elements.

The invention claimed is:

1. A rotary three-phase transformer comprising:

a first portion and a second portion that are movable in rotation relative to each other about an axis A, the first portion comprising a first body of ferromagnetic material and coils, the second portion comprising a second body of ferromagnetic material and coils;

the first body defining a first annular slot of axis A, a second annular slot of axis A, a third annular slot of axis A, and a fourth annular slot of axis A;

the coils of the first portion comprising a first toroidal coil of axis A in the first slot, a second toroidal coil of axis A in the second slot, a third toroidal coil of axis A in the second slot, a fourth toroidal coil of axis A in the third slot, a fifth toroidal coil of axis A in the third slot, and a sixth toroidal coil of axis A in the fourth slot;

the first coil and the second coil being connected in series and presenting respective winding directions that, for a current flowing in the first coil and in the second coil, correspond to two magnetic potentials of opposite directions;

the third coil and the fourth coil being connected in series and presenting respective winding directions that, for a current flowing in the third coil and the fourth coil, correspond to two magnetic potentials of opposite directions; and the fifth coil and the sixth coil being connected in series and presenting respective winding directions that, for a current flowing in the third coil and the sixth coil, correspond to two magnetic potentials of opposite directions.

2. A transformer according to claim 1, wherein the first coil, the second coil, the third coil, the fourth coil, the fifth coil, and the sixth coil all present a same number of turns.

3. A transformer according to claim 1, wherein the second body defines a fifth annular slot of axis A, a sixth annular slot of axis A, a seventh annular slot of axis A, and an eighth annular slot of axis A;

the coils of the second portion comprise a seventh toroidal coil of axis A in the fifth slot, an eighth toroidal coil of axis A in the sixth slot, a ninth toroidal coil of axis A in the sixth slot, a tenth toroidal coil of axis A in the seventh slot, an eleventh toroidal coil of axis A in the seventh slot, and a twelfth toroidal coil of axis A in the eighth slot;

the seventh coil and the eighth coil being connected in series and presenting respective winding directions that, for a current flowing in the seventh coil and in the eighth coil, correspond to two magnetic potentials of opposite directions;

the ninth coil and the tenth coil being connected in series and presenting respective winding directions that, for a current flowing in the ninth coil and in the tenth coil, correspond to two magnetic potentials of opposite directions; and the eleventh coil and the twelfth coil being connected in series and presenting respective winding directions that, for a current flowing in the eleventh coil and in the twelfth coil, correspond to two magnetic potentials of opposite directions.

4. A transformer according to claim 3, wherein the seventh coil, the eighth coil, the ninth coil, the tenth coil, the eleventh coil, and the twelfth coil all present a same number of turns.

5. A transformer according to claim 1, wherein the first body comprises a ring, a first leg, a second leg, a third leg, a fourth leg, and a fifth leg defining the slots of the first body.

6. A transformer according to claim 1, wherein the second portion surrounds the first portion around the axis A, or vice versa.

7. A transformer according to claim 1, wherein the first portion and the second portion are situated one beside the other in the direction of the axis A.

8. A transformer according to claim 1, wherein the first and second bodies made of ferromagnetic material completely surround the coils.

* * * * *